US006712682B2

(12) United States Patent
Thyssen

(10) Patent No.: US 6,712,682 B2
(45) Date of Patent: Mar. 30, 2004

(54) GRINDING WHEEL FIXTURE

(75) Inventor: Wolfgang Thyssen, Wallisellen (CH)

(73) Assignee: Reishauer AG, Wallisellen (CH)

( * ) Notice: Subject to any disclaimer, the term of this patent is extended or adjusted under 35 U.S.C. 154(b) by 0 days.

(21) Appl. No.: 10/366,505

(22) Filed: Feb. 14, 2003

(65) Prior Publication Data

US 2003/0157873 A1 Aug. 21, 2003

(30) Foreign Application Priority Data

Feb. 15, 2002 (DE) ..... 102 06 284

(51) Int. Cl.[7] ..... B23F 21/03

(52) U.S. Cl. ..... 451/541; 451/540; 451/542; 451/543; 451/548

(58) Field of Search ..... 451/540, 541, 451/542, 543, 548

(56) References Cited

U.S. PATENT DOCUMENTS 4,683,681 A * 8/1987 Russ, III ..... 451/343

FOREIGN PATENT DOCUMENTS

DE 42 22 535 1/1994
DE 196 47 452 6/1998
DE 196 47 452 C1 * 6/1998 ..... B24B/45/00

* cited by examiner

*Primary Examiner*—Joseph J. Hail, III
*Assistant Examiner*—Shantese McDonald
(74) *Attorney, Agent, or Firm*—Browdy and Neimark

(57) ABSTRACT

A grinding wheel fixture (S) for the accommodation of a dressable grinding wheel (5) is provided with an annular groove (6, 6', 8) for the accommodation of balancing lugs (9, 10), the balancing lugs (9, 10) being for manual balancing purposes displaceable and fixable within the annular groove (6, 6', 8) with respect to their angular position. The balancing lugs (9, 10) are divisible into at least two groups, the groups being displaceable and fixable in any desirable angular position independent of each other. The grinding wheel fixture permits a simple, quick, and nevertheless highly exact dynamic balancing, whereby repeated re-measurement and repeated correction are no longer necessary.

8 Claims, 3 Drawing Sheets

GRINDING WHEEL FIXTURE

The benefit under 35 Usc §119 is claimed of the filing date of: Application No. 10206284.6 in Germany on Feb. 15, 2002. A certified copy of said priority document is attached.

FIELD OF THE INVENTION

The invention concerns a grinding wheel fixture. The grinding wheel fixture serves for the fixture of dressable grinding wheels, in particular of grinding worms.

BACKGROUND OF THE INVENTION

In the machining of workpieces on grinding machines, an important pre-requisite for the attainment of high grinding quality is that the grinding spindle runs with as little vibration as possible. Since the grinding spindle is connected to a grinding wheel, in particular a grinding worm, by way of a grinding wheel fixture, this is only attainable if the grinding wheel and the accommodating grinding wheel fixture are together in a high grade state of balance. For this reason the balancing of grinding wheel and grinding wheel fixture takes place in the assembled state on a balancing machine and/or, as long as the grinding machine is provided with a balancing device, in the state of fixture on the grinding spindle. An automatic balancing device suited to this purpose is described in DE 42 22 535. The single-plane balancing device with balancing lugs rotatable by motor is located in the centre of rotation of the grinding wheel. Since, however, for the attainment of a high quality of balance, the balancing range of a balancing device incorporated on the machine is necessarily small as in DE 42 22 535, and balancing on the machine is limited to one balancing plane (static balancing), broad grinding wheels in particular must be previously balanced dynamically by hand, i.e. in two balancing planes, to a high quality of balance on a balancing machine in the state of assembly with the grinding wheel fixture.

DE-A-196'47'452 discloses a grinding wheel fixture with three balancing lugs, which are displaceably located in a common groove, thus permitting a manual balancing in one plane.

Cases moreover occur in which the state of balance of the grinding wheel alters during grinding. This can be caused, for example, by material removal in later dressing operations due to inhomogenity in the grinding wheel, or due to geometrical alterations on the grinding wheel periphery. An example of this is found in grinding worms which are employed for the continuous generating grinding of gears. In such cases, even if a balancing device is provided on the grinding machine, the grinding process must be interrupted from time to time, and the dynamic balancing process repeated on the balancing machine.

In order to allow dynamic balancing, the grinding wheel fixtures are provided with a concentric annular groove on each of their end faces, in which groove balancing lugs can be displaced and fixed in the desired position. By altering the position of the balancing lugs an alteration in the state of balance can be achieved. Shifting of the balancing lugs takes place by hand, whereupon they are clamped in the appropriate angular position according to the measure of out-of-balance indicated by the balancing machine. The balancing lugs are usually of roughly the same size without observation of tolerance specifications.

As especially in the case of large module grinding worms the initial out-of-balance after fitting the grinding worm to the fixture body can be substantial due to the emergence of the grinding worm threads at the end faces, balancing lugs of relatively large mass are required. To enable a high quality of balance to nevertheless be attained with these large masses, the angular positions of the balancing lugs must correspond very exactly with the position indicated on the balancing machine. This is only attainable with difficulty, and demands time consuming, repeated measuring and correcting with every initial and repeat balancing operation.

SUMMARY OF THE INVENTION

It is an object of the invention to provide a device which permits the quick, simple, and yet precise balancing of a grinding wheel fixture together with its grinding wheel.

This object is achieved with a grinding wheel fixture having the characteristics of claim 1.

The grinding wheel fixture according to the invention is provided with at least two groups of balancing lugs which are arranged on the same end face of the grinding wheel fixture, the groups being capable of being displaced to and fixed in any desired angular positions independent of each other. To this purpose the individual groups of balancing lugs are arranged in the same balancing plane or in closely adjacent balancing planes.

The balancing process can thus be divided into an initial balancing with a first group of balancing lugs and a fine balancing with a second group of balancing lugs. Initial balancing is preferably performed with heavier balancing lugs than the fine balancing.

In a first embodiment these balancing planes are arranged one beside the other in the axial direction, in that the balancing lugs are located in a counter-recessed annular groove. In another embodiment the annular grooves are arranged radially adjacent, each pair of balancing lugs being located in its own annular groove, and the grooves being concentrically adjacent.

The individual groups of balancing lugs differ in the masses of the individual balancing lugs, which are preferably of a ratio between 1:5 and 1:20.

A circular scale is preferably provided on the end face of the grinding wheel fixture, which permits a fairly accurate positioning of the balancing lugs. By this means, even in the case of high demands on the state of balance, a subsequent correction of the position of the balancing lugs can generally be avoided.

Further advantageous embodiments are indicated in the dependent claims.

BRIEF DESCRIPTION OF THE DRAWINGS

In the following the subject of the invention is explained with reference to preferred embodiments which are represented in the annexed drawings. These depict.

DETAILED DESCRIPTION OF PREFERRED EMBODIMENTS

Figure 1:
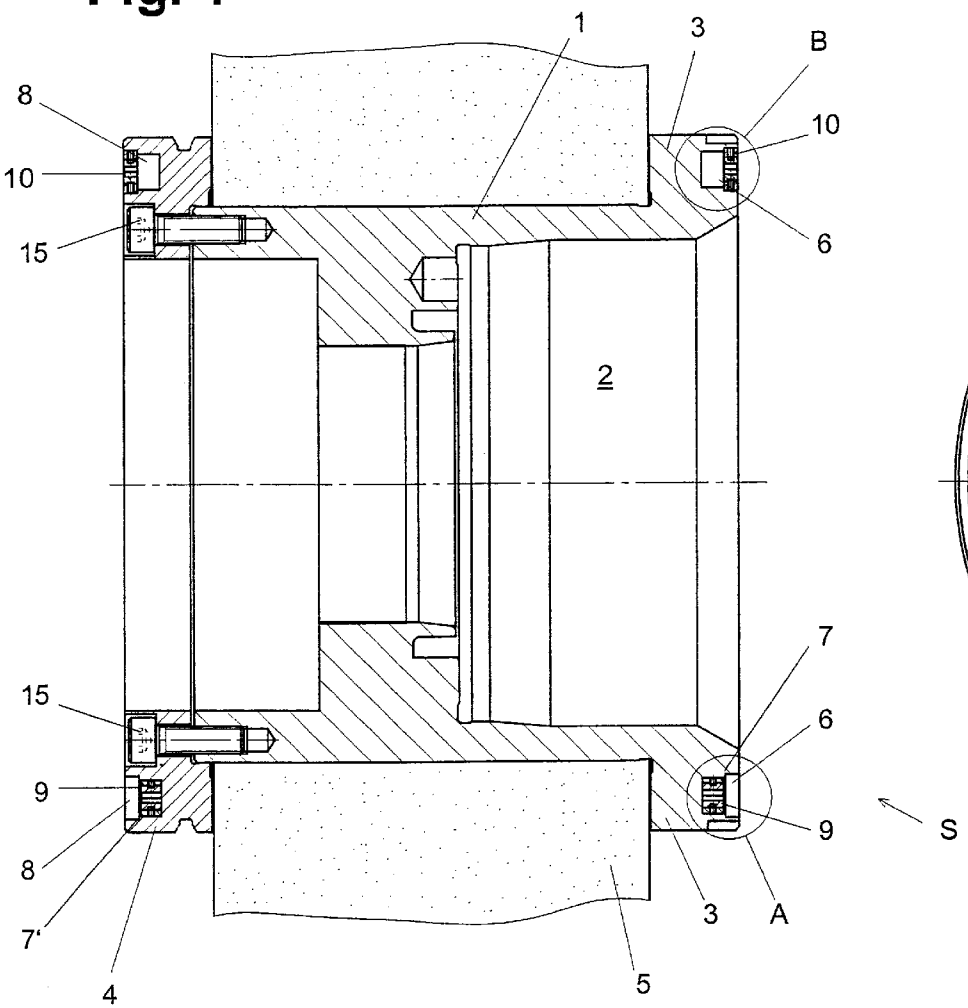
FIG. 1 shows an axial section through a grinding wheel fixture according to the invention, together with an attached grinding wheel.

A first embodiment of a grinding wheel fixture S according to the invention is shown in FIG. 1. It serves to accommodate a grinding wheel 5, in particular a grinding worm, and is employed for example in continuous generation grinding. The grinding wheel fixture S has a cylindrical fixture body 1, on the outer surface of which the grinding wheel 5 is located. The body 1 is provided with an axially stepped bore 2 for accommodating a grinding spindle. If the grinding wheel fixture S is balanced together with the grinding wheel 5 on a balancing machine, the bore 2 serves to accommodate a balancing mandrel of the balancing machine, so that dynamic balancing can be undertaken at full grinding speed under the same fixture conditions. Formed on one end face of the fixture body 1 is an integral flange 3. Attached with fixture screws 15 to the other end is a flange cover 4. The grinding wheel is thus held between flange 3 and flange cover 4.

Figure 4A:
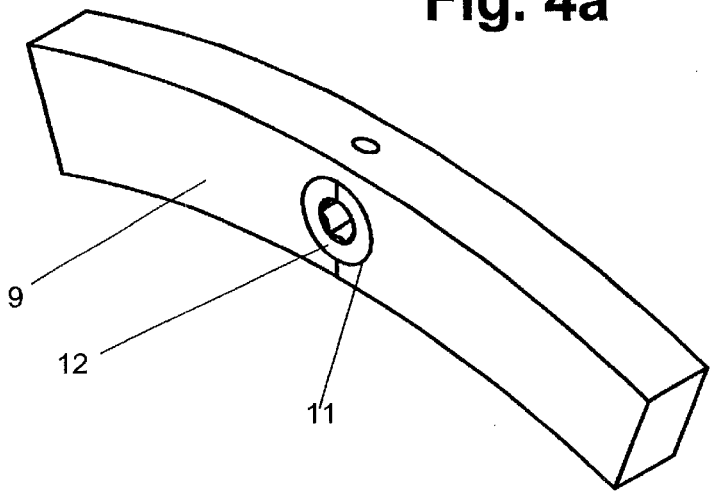
FIG. 4*a* shows a perspective view of a first balancing lug of large mass.
Figure 4B:
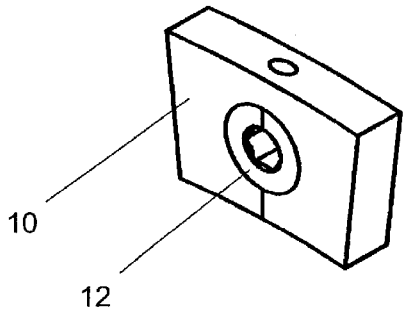
FIG. 4*b* shows a perspective view of a second balancing lug of small mass.
Figure 5A:
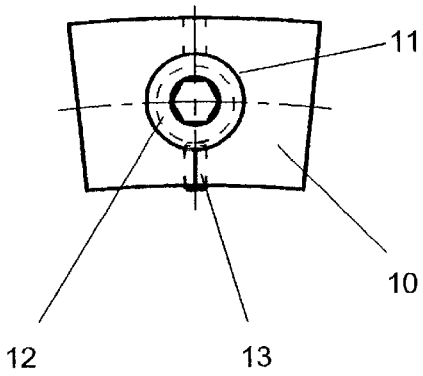
FIG. 5*a* shows a front view of the balancing lug according to FIG. 4*b;*
Figure 5B:
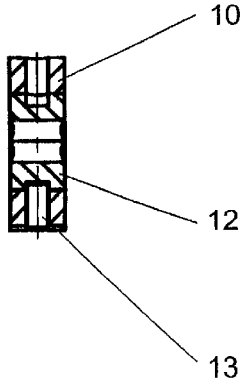
FIG. 5*b* shows a cross-section through the balancing lug according to FIG. 4*b.

Provided on at least one end face of the grinding wheel fixture S, here on both, is a surrounding concentric annular groove 6, 8. In accordance with the invention, these annular grooves 6, 8 are provided on both sides with a surrounding shoulder 7,7', forming a lower and an upper circular groove part 60 and 61. Arranged in these shouldered annular grooves 6, 8 are circular segment shaped balancing lugs 9, 10 which can be shifted within the annular grooves 6, 8 and fixed at any desirable point. As is shown in FIGS. 4*a* and 4*b,* the balancing lugs 9, 10 are each provided with a hole 11 in which a cam stud 12 is located for rotation. From the hole 11 a pin 13 extends radially inwards, as shown in the FIGS. 5*a* and 5*b*. By rotating the cam stud 12 with a suitable tool, with an allen key for example, the pin 13 is pressed against the wall of the annular groove 6, 8, and the balancing lug 9, 10 thereby fixed in the annular groove 6, 8. Other forms of clamping or fixture are also possible, however.

The balancing lugs 9, 10 can be grouped into pairs, the balancing lugs 9, 10 of the same pair being at least of approximately the same mass, and the balancing lugs 9, 10 of different pairs being of different mass. Preferably the masses of the same pair differ from each other by maximum ±10 mg. The masses of the balancing lugs 9, 10 of different pairs differ from each other preferably by a ratio of between 1:5 and 1:20. Thus heavier and lighter balancing lugs 9, 10 are provided.

Figure 3A:
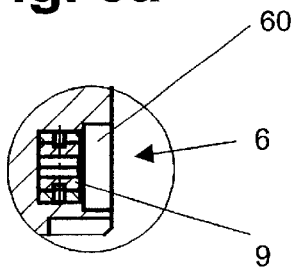
FIG. 3*a* shows an enlargement of the detail A according to FIG. 1.
Figure 3B:
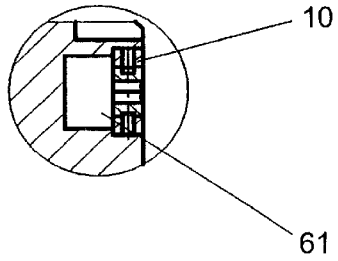
FIG. 3*b* shows an enlargement of the detail B according to FIG. 1.

In the example illustrated here the heavier balancing lugs 9 are located and fixed in the lower groove part 61, and the lighter balancing lugs 10 in the upper groove part 60. The heavier balancing lugs 9 therefore, as shown in the FIGS. 3*a* and 4*a,* are made narrower and instead longer than the lighter balancing lugs 10, which are shown in the FIGS. 3*b* and 4*b*.

Figure 2:
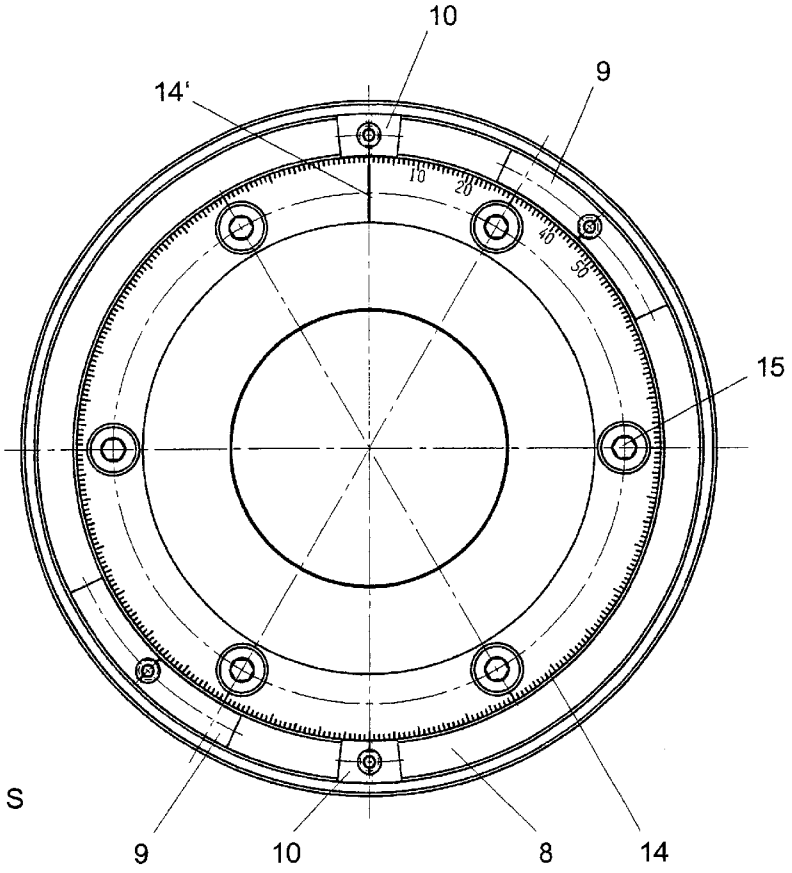
FIG. 2 shows a front view of the grinding wheel fixture according to FIG. 1.

As is best seen from FIG. 2, the balancing lugs 9, 10 can be fixed in any desirable angular positions for balancing purposes. The shouldered annular grooves 6, 8 moreover allow the smaller, lighter balancing lugs 10 to be arranged above the heavier balancing lugs 9. The balancing process can thus be divided into two operational phases: an initial balancing with the lower lying heavier balancing lugs 9, and a subsequent fine balancing with the upper lying lighter balancing lugs 10. To assure attainment of a high quality state of balance, the relevant masses of the balancing lugs 9, 10 are made to very close tolerance and to the above stated mass ratio.

To facilitate balancing there is furthermore a surrounding concentric circular scale 14 provided on the outer end face of flange 3 and flange cover 4 in the vicinity of the annular grooves 6, 8. This circular scale 14 permits an exact positioning of the balancing lugs 9, 10 according to the angular reading of the balancing machine. To this purpose the grinding wheel fixture S, i.e. the circular scale 14 has a zero degree mark 14', which can be brought into coincidence with a zero point of an angular measuring device of the balancing machine when setting up the grinding wheel fixture on the balancing machine. For this exact set-up, known means are employed which are not dealt with here.

For initial balancing, the lighter, second balancing lugs 10 are removed from flange 3 and flange cover 4, and after a first out-of-balance measurement at a speed below the grinding speed the heavier, first balancing lugs 9 are brought into position according to the angular reading of the balancing machine. Subsequently after a fresh out-of-balance measurement at grinding speed the lighter, second balancing lugs 10 are positioned at the position indicated by the balancing machine.

Figure 6:
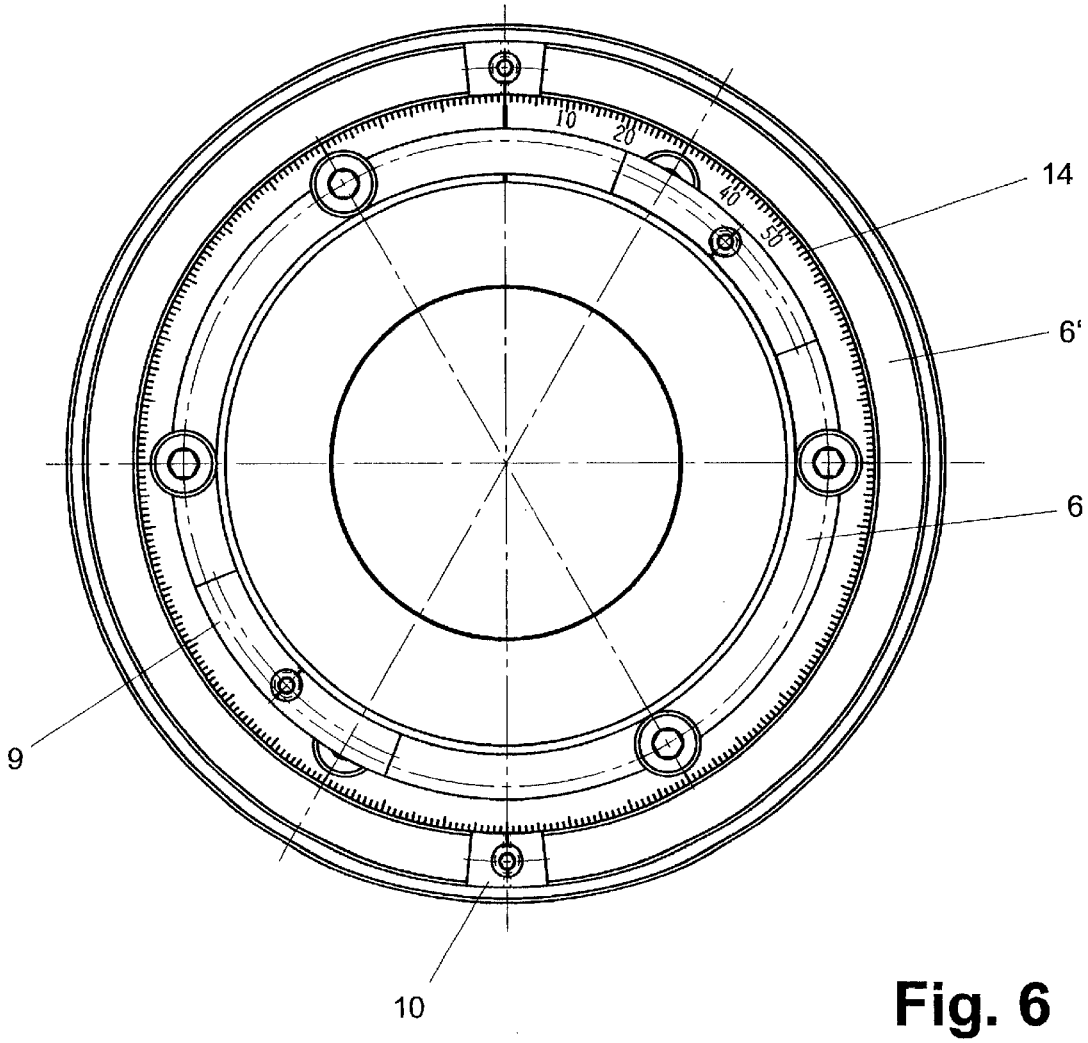
* and FIG. 6 shows a front view of the grinding wheel fixture according to the invention in a second form of construction.

Illustrated in FIG. 6 is a second embodiment of a grinding wheel fixture S according to the invention. It is substantially of the same construction as the fixture already described. Instead of the shouldered annular grooves 6, 8, however, it is provided with two surrounding adjacent concentric annular grooves 6, 6'. The first groove 6 serves again to accommodate the heavier balancing lugs 9 for initial balancing. The adjacent groove 6', which preferably has a larger radius than the first annular groove 6, and hence surrounds the latter, serves to accommodate the lighter balancing lugs 10 for the fine balancing. It is also possible to provide one end face of the grinding wheel fixture S with a shouldered annular groove, and the other with two adjacently arranged annular grooves.

Although in each of the examples illustrated here two pairs of balancing lugs are described, it is also possible to combine three or four balancing lugs in groups of like mass, and/or employ more than two groups of balancing lugs in more than two annular grooves or groove parts.

The grinding wheel fixture according to the invention permits a simple, quick and yet highly exact dynamic balancing, whereby a repeated re-measurement and repeat correction are no longer necessary.

List of Reference Numbers

| | |
|---|---|
| S | Grinding wheel fixture |
| 1 | Fixture body |
| 2 | Axial bore |
| 3 | Flange (integral) |
| 4 | Flange cover |
| 5 | Grinding wheel |
| 6 | First annular groove |
| 60 | Lower groove part |
| 61 | Upper groove part |
| 6' | First adjacent groove |
| 7 | Shoulder |
| 7' | Shoulder |
| 8 | Second annular groove |
| 9 | First balancing lug |

-continued

| | |
|---|---|
| 10 | Second balancing lug |
| 11 | Hole |
| 12 | Cam stud |
| 13 | Pin |
| 14 | Circular scale |
| 14' | Zero mark |
| 15 | Fixture screw |

What is claimed is:

1. Grinding wheel fixture for accommodating a dressable grinding wheel with an annular groove, which is arranged in an end face of the grinding wheel fixture, and with balancing lugs, which for purpose of manual balancing are displaceable to and fixable in their angular position within the annular groove, wherein the balancing lugs on the said end face of the grinding wheel fixture are arranged in at least two groups, the lugs of a first group being displaceable and fixable in any desired angular position between 0° and 360° independent of the position of the lugs of the at least one second group.

2. Grinding wheel fixture according to claim 1 wherein balancing lugs of a same group of the at least two groups are of at least approximately the same mass, and in which the balancing lugs of different groups of the at least two groups are of masses which differ from each other in the ratio of between 1:5 and 1:20.

3. Grinding wheel fixture according claim 1, wherein the balancing lugs of a same group of the at least two groups are of masses which differ by a maximum of 10 mg.

4. Grinding wheel fixture according to claim 1, wherein every balancing lug is provided with a cam stud and a pin, by means of which the balancing lug is fixable in the radial direction in the annular groove.

5. Grinding wheel fixture for accommodating a dressable grinding wheel with an annular groove, which is arranged in an end face of the grinding wheel fixture, and with balancing lugs, which for purpose of manual balancing are displaceable to and fixable in their angular position within the annular groove, wherein the balancing lugs on the said end face of the grinding wheel fixture are arranged in at least two groups, the groups being displaceable and fixable in any desired angular position independent of each other, wherein the annular groove is provided with shoulders which divide the annular groove into an upper circular groove part and a lower circular groove part, a first group of balancing lugs being arranged in the lower groove part and a second group of balancing lugs in the upper groove part.

6. Grinding wheel fixture for accommodating a dressable grinding wheel with two annular grooves, which are arranged in an end face of the grinding wheel fixture, and with balancing lugs, which for purpose of manual balancing are displaceable to and fixable in their angular position within the annular grooves, wherein the balancing lugs on the said end face of the grinding wheel fixture are arranged in at least two groups, the groups being displaceable and fixable in any desired angular position independent of each other, wherein the two annular grooves are arranged next to each other, at least one group of balancing lugs being arranged in each annular groove.

7. Grinding wheel fixture for accommodating a dressable grinding wheel with an annular groove, which is arranged in an end face of the grinding wheel fixture, and with balancing lugs, which for purpose of manual balancing are displaceable to and fixable in their angular position within the annular groove, wherein the balancing lugs on the said end face of the grinding wheel fixture are arranged in at least two groups, the groups being displaceable and fixable in any desired angular position independent of each other, wherein on the opposite end face of the grinding wheel fixture at least a second annular groove for the accommodation of balancing lugs, and at least two groups of balancing lugs are provided, the groups being displaceable to and fixable in any desired angular position independent of each other.

8. Grinding wheel fixture for accommodating a dressable grinding wheel with an annular groove, which is arranged in an end face of the grinding wheel fixture, and with balancing lugs, which for purpose of manual balancing are displaceable to and fixable in their angular position within the annular groove, wherein the balancing lugs on the said end face of the grinding wheel fixture are arranged in at least two groups, the groups being displaceable and fixable in any desired angular position independent of each other wherein on the stated end face a circular scale is provided for the exact angular positioning of the balancing lugs, which possesses a zero mark which can be brought into coincidence with the zero mark of an angular out-of-balance indicator of a balancing machine.

* * * * *